US005511472A

United States Patent [19]

Taylor

[11] Patent Number: 5,511,472

[45] Date of Patent: Apr. 30, 1996

[54] EMBOSSING PAPER APPARATUS

[76] Inventor: Nancy R. Taylor, 33495 Spinnaker Dr., Dana Point, Calif. 92629

[21] Appl. No.: 354,232

[22] Filed: Dec. 7, 1994

[51] Int. Cl.[6] ..... B41F 19/02

[52] U.S. Cl. ..... 101/3.1; 101/28; 434/82

[58] Field of Search ..... 101/3.1, 32, 28, 101/4; 434/87, 82, 83–90

[56] References Cited

U.S. PATENT DOCUMENTS

| | | | |
|---|---|---|---|
| 1,420,765 | 6/1922 | Seitz | 101/3.1 |
| 1,612,841 | 1/1927 | Thonet | 101/4 |
| 1,634,466 | 7/1927 | Kraft | 101/3.1 |
| 2,201,479 | 5/1940 | Davidson | 434/87 |
| 2,293,696 | 8/1942 | Burchell | 434/87 |
| 4,799,317 | 1/1989 | Christian et al. | 434/87 |
| 5,110,295 | 5/1992 | Concra | 434/88 |
| 5,344,358 | 9/1994 | Jantzen | 101/3.1 |

FOREIGN PATENT DOCUMENTS

| | | | |
|---|---|---|---|
| 0332497 | 11/1935 | Italy | 101/32 |

*Primary Examiner*—Edgar S. Burr
*Assistant Examiner*—Anthony H. Nguyen
*Attorney, Agent, or Firm*—H. Michael Brucker

[57] ABSTRACT

Embossing apparatus for artists and hobbyist including a stencil component having one or more cut-outs of designs to be embossed into a piece of paper and a guide component with identical cut-outs and alignment means for aligning like cut-outs of the two components when a piece of paper to be embossed overlays the stencil component.

3 Claims, 3 Drawing Sheets

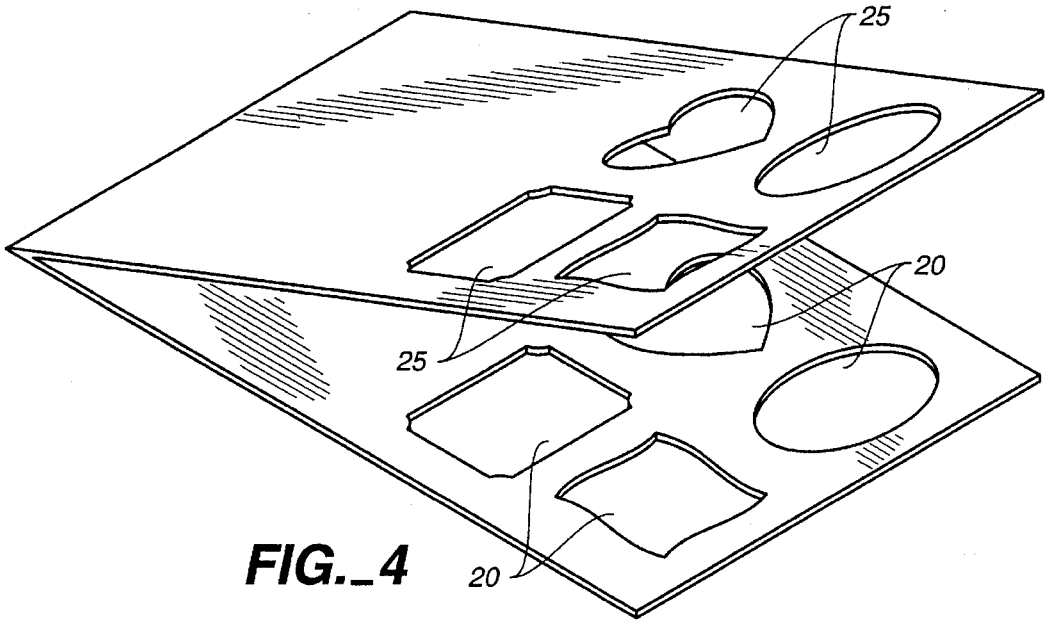
FIG._4
FIG._5
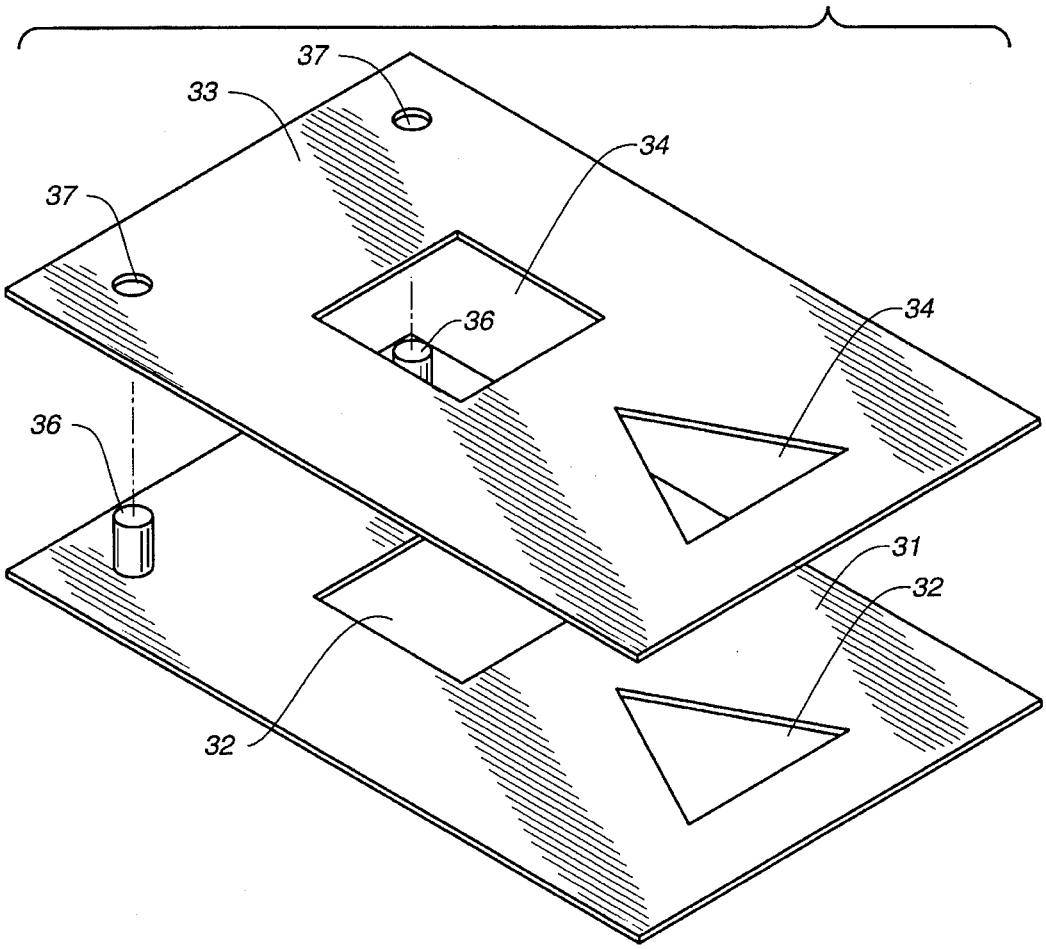

EMBOSSING PAPER APPARATUS

The present invention relates to embossing apparatus and in particular to embossing apparatus for use in connection with paper for the purpose of impressing a design into the paper.

Embossing as it relates to paper, involves causing areas of the paper to be in relief relative to other areas of the paper. The cellulose fibers from which paper is formed are subject to inelastic deformation which permits embossing to occur in response to pressure properly applied to the paper. Elaborate machinery exists for paper embossing on a commercial level, but for the artist or hobbyist, the apparatus available for paper embossing is still quite primitive.

The standard procedure for non-commercial paper embossing involves the use of a stencil, an embossing tool and a light box. The stencils are typically sheets of plastic or brass having one or more cut-out designs. To emboss a design into a piece of paper, the stencil is laid on a light box, the paper to be embossed is laid over the stencil, and an embossing tool applies pressure to the paper at the perimeter of the stencil cut-out. The stencil is of a thickness such that applying pressure to the paper but with the embossing tool at the edge of the cut-out bends the fibers of the paper does not stretch them beyond their breaking point. Once the entire perimeter of the stencil cut-out has been traced by the embossing tool, the paper will be impressed with the traced design and the entire area of the design will appear to be on a different plane than the rest of the paper. The light box creates an outline of the cut-out on the paper to be embossed which acts as the guide for the embossing tool. When a light box is not available, the stencil can be held up to a window or any other source of illumination which will permit the perimeter of the cut-out of the embossing stencil to be seen through the paper which overlays it.

The difficulty which is experienced using the apparatus described above is in keeping the paper aligned with the stencil throughout the embossing procedure and faithfully tracing the perimeter of the stencil cut-out. Because of these problems and others, paper embossing is not an easy task for young hands and even for adults requires a degree of expertise in order to achieve a satisfactory result.

Using the apparatus of the present invention, paper embossing is accomplished without the requirement of a light box of any sort and so simplifies the procedure that youngsters and first time embossers achieve excellent results immediately.

With the apparatus of the present invention embossing is achieved by the use of an embossing tool scribing the perimeter of a stencil cut-out. In the present invention, however, the stencil, rather than being a single sheet of material with one or more cut-outs, comprises a pair of substantially identical sheets with identical cut-outs and means for aligning the like cut-out when a piece of paper to be embossed is interposed between the two stencil components. The bottom stencil component, provides the perimeter or edge at which the paper fibers are deformed as in the prior art. The upper stencil component, provides a positive guide member for the embossing tool assuring that the embossing tool applies pressure in precisely the correct location to achieve a crisp and accurate impression of the stencil cut-out into the paper. In its preferred embodiment, the apparatus of the present invention is formed from a single sheet of material which is scored to form a hinge which permits one area of the material to overlay the other. Identical cut-outs on either side of the score line are automatically aligned when one portion of the stencil is brought in contact with the other by rotation about the hinge line. A piece of paper to be embossed is inserted between the two components of the stencil, and the embossing tool applies pressure to the paper as it traces the exposed cut-out.

It is an object of the present invention to provide a stencil apparatus for paper embossing which permits the accurate impression of a design into paper without the use of a light box.

A further object of the present invention is to provide embossing apparatus for impressing a design into a piece of paper which has a positive guide for the application of pressure to the paper with an embossing tool.

Yet a further object of the present invention is to provide embossing apparatus for impressing a design into a piece of paper by the use of a stencil where the alignment of the paper with the stencil during the embossing process is easily maintained with simple hand pressure.

Other objects of the present invention will in part be obvious and will in part appear hereafter.

BRIEF DESCRIPTION OF THE DRAWINGS

FIG. 4 is similar to FIG. 1 showing a plurality of different stencil cut-outs; and FIG. 5 is an isometric illustration of an alternative embodiment of the embossing apparatus of the present invention wherein alignment is achieved by guide pegs and holes as oppose to a hinge.

DESCRIPTION OF PREFERRED EMBODIMENT

Figure 1:
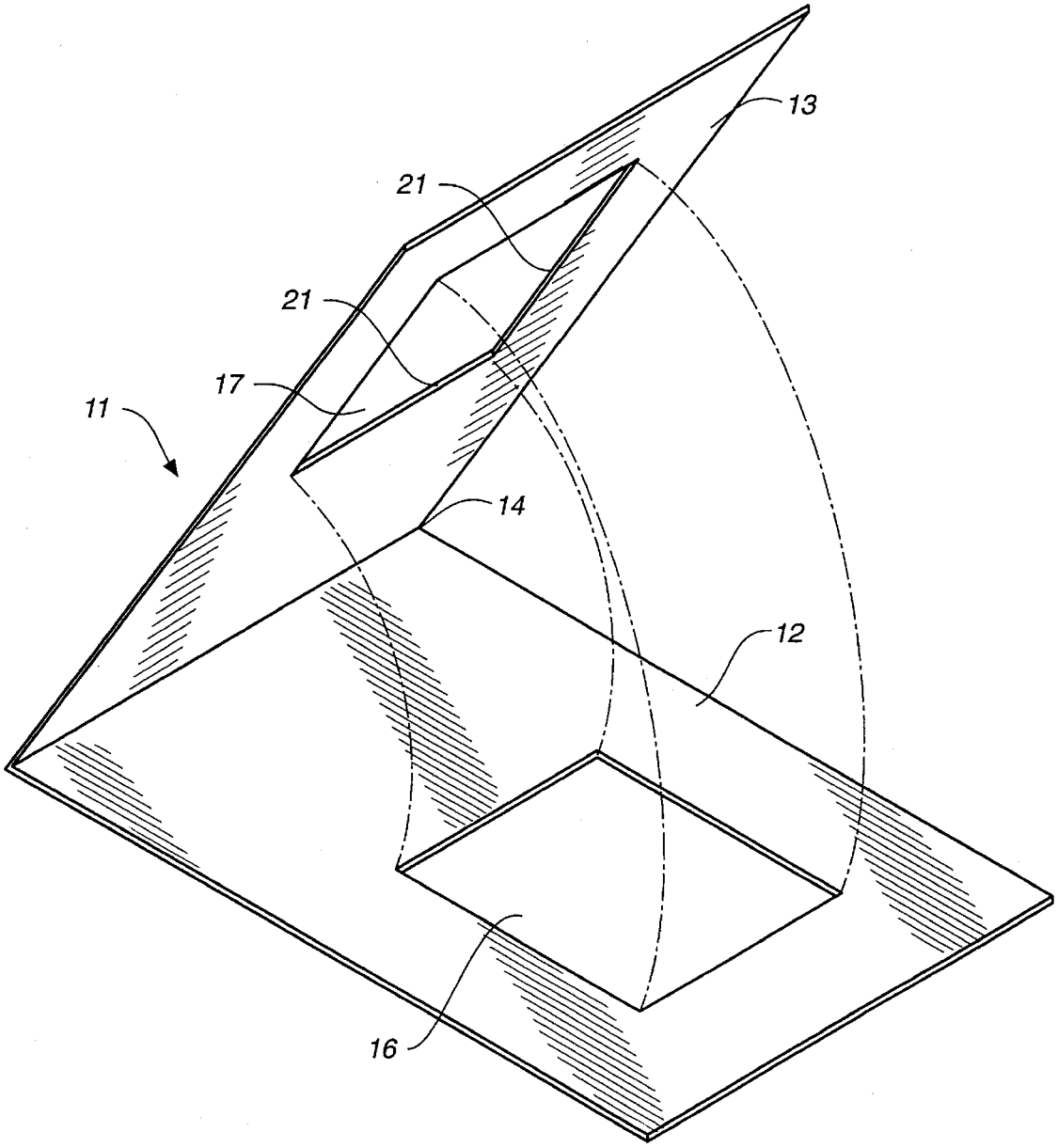
FIG. 1 is an isometric illustration of the embossing apparatus of the present invention.
Figure 2:
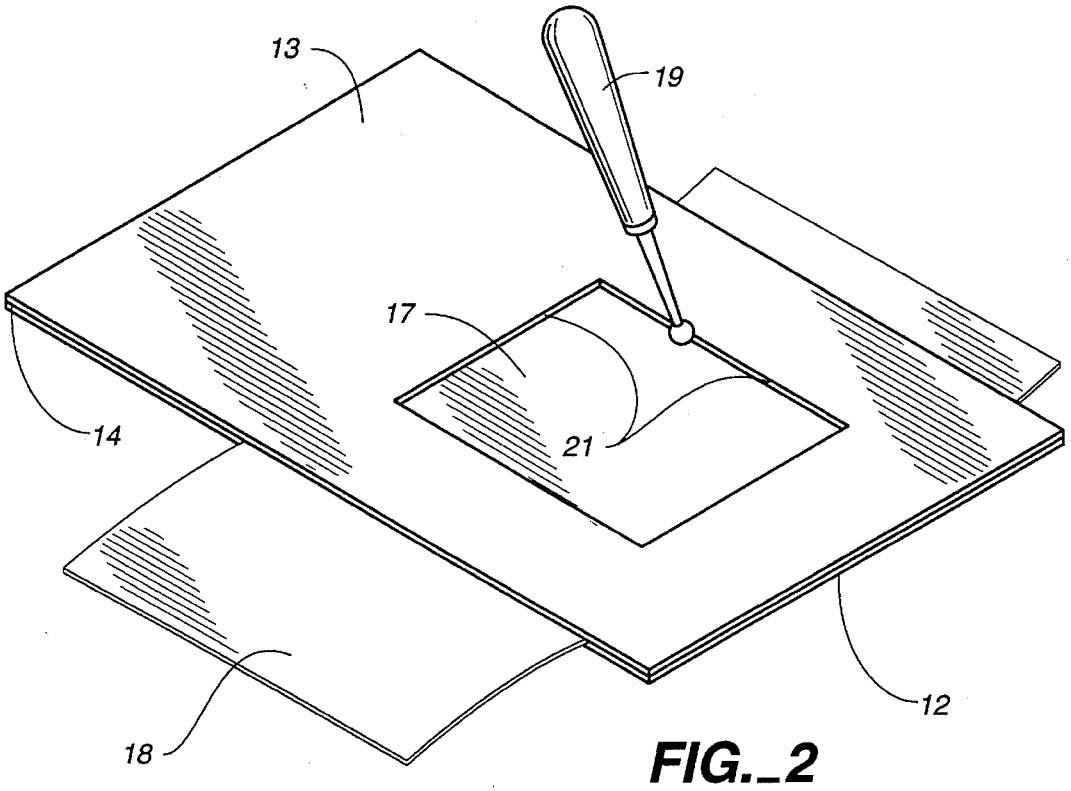
FIG. 2 is an isometric illustration of the apparatus of the present invention shown in a combination with a sheet of paper to be embossed and an embossing tool.

Referring to FIGS. 1 and 2, an embossing apparatus 11, according to the present invention, includes a lower embossing stencil member 12 and an upper embossing stencil guide member 13 joined by a hinge 14 which permits guide member 13 to overlay stencil member 12.

The stencil member 12 includes a cut-out 16 of a shape that can be impressed into a piece of paper. The upper guide member 13 includes a cut-out 17, identical to cut-out 16, located on the guide member 13 such that when guide member 13 is rotated about hinge 14 to overlay stencil 12, cut-outs 16 and 17 are perfectly aligned.

A piece of paper 18 to be embossed is inserted between guide member 13 and stencil member 12 and held in place by simple hand pressure applied to guide member 13 while an embossing tool 19 scribes the perimeter of the guide cut-out 17. The guide cut-out 17, which is perfectly aligned with stencil cut-out 16, locates for the user of the apparatus the hidden perimeter of stencil cut-out 16. By directing the embossing tool against the edge surfaces 21 of the guide cut-out 17, as well as toward the stencil cut-out 16, while scribing the perimeter of the cut-out 17, fiber deformation takes place precisely at the edge of stencil cut-out 16 where it is desired.

Figure 3:
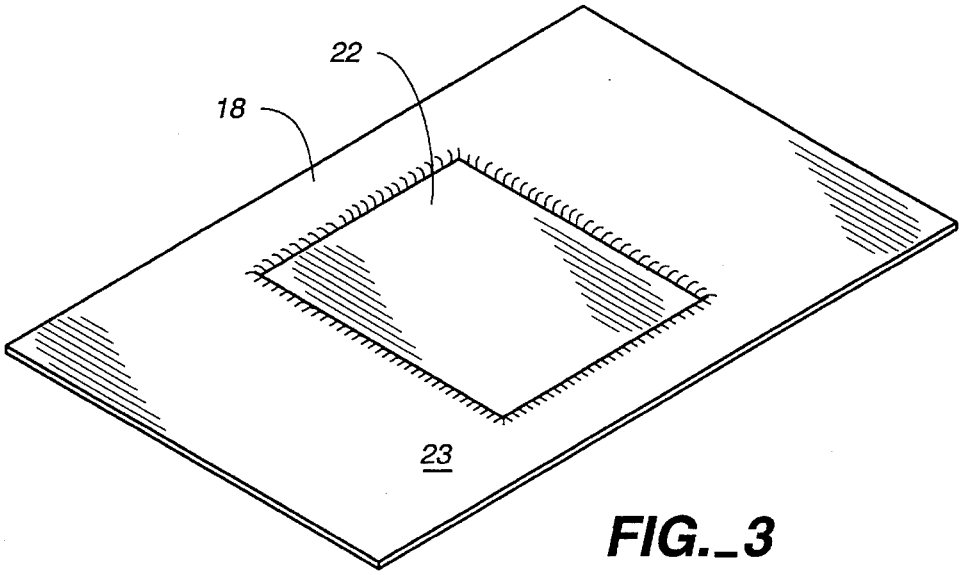
FIG. 3 is an isometric illustration of the piece of paper which has been embossed using the apparatus of FIGS. 1 and 2.

Referring to FIG. 3, once the embossing tool 19 has scribed the entire perimeter of the guide cut-out 17 and thereby deformed the fibers of the paper 18 by forcing them over the edge of the perimeter of stencil 16, the paper is removed. The paper 18 will have an embossed area 22 therein which is at a plane below the surface 23 of paper 18. The shape of the depressed area 22 is determined by the shape of stencil cut-out 16 and embossing guide cut-out 17 which, can be of any shape desired. For convenience, a single apparatus as taught by the present invention can include a plurality of different shaped stencil cut-outs 20 and corresponding embossing guide cut-outs 25 as shown in FIG. 4.

The embossing apparatus of the present invention can be constructed from a single piece of heavy weight paper scored to permit one-half of the area of the paper to overlay the other half and including a plurality of cut-outs of different shapes which align to provide a stencil portion and a guide portion as described above. More complex apparatus embodying the present invention is well within the skill of the art. For example, the stencil member and the guide member can be formed from more permanent materials than paper such as plastic or even wood and joined together by an actual mechanical hinge. In another embodiment the stencil member and guide member are separate components with a simple alignment mechanism at a periphery to permit one component to overlay the other in the precise relative position in which the guide cut-outs and the stencils cut-out are perfectly aligned.

Referring to FIG. 5, a stencil member 31 having a plurality of cutouts 32 together with a guide member 33 having cut-outs 34 identical to cut-outs 32 form the stencil member and guide member as described in more detail above. Pegs 36 permanently affixed to stencil member 31, are sized to fit through holes 37 formed in guide member 33. When the pegs 36 are inserted into holes 37, the like-shaped stencil cut-outs 32 and guide cut-outs 34 are automatically perfectly aligned. The pegs 36 and holes 37 provide the same function as the hinge 14 of the embodiment of FIGS. 1 and 2 in permitting the guide cut-outs 34 to locate the embossing tool at the edge of the stencil cut-out being employed after a piece of paper to be embossed has been placed over the stencil member and thereby masked the precise location of the stencil cut-out. The pegs and the holes can be on either of the guide member 33 or stencil member 31.

The essence of the invention in the provision of an upper guide member with cut-outs identical to the those of the stencil member and means for aligning the two so as to permit the user of the apparatus to accurately scribe the perimeter of the stencil cut-out after it has been hidden by the paper to be embossed. Thus, the present invention is not to be limited by any of the specific embodiments or examples set forth above, beyond those limitations specifically set forth in the following claims.

I claim:

1. Embossing apparatus for hand embossing a shape into a sheet of paper the apparatus consisting of:

a planar stencil member having a plurality of peripheral edges forming a polygon and a plurality of different shaped stencil cut-outs having particular shape-defining perimeters;

a planar guide member having a plurality of peripheral edges forming a polygon and a plurality of different shaped guide cut-outs having particular shape-defining perimeters defining the identical shapes as said stencil cut-outs wherein said guide member cut-out perimeters provide a positive structure for guiding the point of the embossing tool;

connection means hingedly connecting said stencil member and said guide member along one only of their respective peripheral edges and aligning said stencil cut-outs and said guide cut-outs when said guide member and said stencil member are overlaid one onto the other about said connection member causing the perimeters of said guide member cut-outs and the perimeters of said stencil member cut-outs to be aligned, said peripheral edges of said stencil member and said guide member, other than those connected, being unconnected and thereby free to have the paper to be embossed slidably disposed therebetween allowing the paper to be embossed to be larger than said stencil and said guide and positionable relative to said guide member and said stencil member to have a selected cutout placed on the paper at a desired location on the paper, an embossing tool for hand scribing the perimeter of a guide member cut-out when it is aligned with the perimeter of its corresponding stencil member cut-out whereby a sheet of paper disposed between said stencil member and said guide member covering the area of said guide member cut-out scribed will be impressed with a geometric shape corresponding to the shape of the guide member cut-out and its corresponding stencil member cut-out.

2. The apparatus of claim 1 wherein said alignment means is a hinge.

3. The apparatus of claim 2 wherein said stencil member and said guide member are formed from a single sheet of material and said hinge is a score line in said sheet of material.

* * * * *